US012060678B2

(12) United States Patent
Loy et al.

(10) Patent No.: US 12,060,678 B2
(45) Date of Patent: Aug. 13, 2024

(54) METHODS AND SYSTEMS TO DYE TEXTILE MATERIALS WITH DYE BLEND COMPOSITIONS HAVING DIFFERENTIAL DYE EXHAUST RATES

(71) Applicant: INDIGO MILL DESIGNS, INC., Cary, NC (US)

(72) Inventors: Vince Loy, Cary, NC (US); Howard Malpass, Cary, NC (US); Ralph Tharpe, Cary, NC (US); M. Dean Ethridge, Cary, NC (US); Sudhakar Puvvada, Cary, NC (US)

(73) Assignee: INDIGO MILL DESIGNS, INC., Cary, NC (US)

( * ) Notice: Subject to any disclaimer, the term of this patent is extended or adjusted under 35 U.S.C. 154(b) by 103 days.

(21) Appl. No.: 17/793,257

(22) PCT Filed: Jan. 12, 2021

(86) PCT No.: PCT/US2021/013049
§ 371 (c)(1),
(2) Date: Jul. 15, 2022

(87) PCT Pub. No.: WO2021/146172
PCT Pub. Date: Jul. 22, 2021

(65) Prior Publication Data

US 2023/0340726 A1 Oct. 26, 2023

Related U.S. Application Data

(60) Provisional application No. 62/961,917, filed on Jan. 16, 2020.

(51) Int. Cl.
*D06B 21/00* (2006.01)
*D06B 1/02* (2006.01)
(Continued)

(52) U.S. Cl.
CPC ..... *D06P 5/001* (2013.01); *D06B 1/02* (2013.01); *D06B 19/0094* (2013.01);
(Continued)

(58) Field of Classification Search
CPC .. D06P 5/001; D06P 1/228; D06P 1/30; D06P 1/22; D06B 1/02; D06B 19/0094;
(Continued)

(56) References Cited

U.S. PATENT DOCUMENTS 6,355,073 B1 3/2002 Godau
6,537,333 B2 3/2003 Hipp et al.
(Continued)

FOREIGN PATENT DOCUMENTS

DE 10 2008 039500 2/2010
EP 3 530 792 8/2019
WO 2017/208134 12/2017

OTHER PUBLICATIONS

International Search Report and Written Opinion of the ISA for PCT/US2021/013049, dated Apr. 26, 2021 (13 pages).

*Primary Examiner* — Eisa B Elhilo
(74) *Attorney, Agent, or Firm* — NIXON & VANDERHYE P.C.

(57) ABSTRACT

Processes and apparatus for dyeing a textile product are provided whereby an undyed textile product is introduced into a substantially anaerobic dyeing chamber having an oxygen content of less than 1000 ppm oxygen therein, and at least two dye mixtures having a differential dye exhaustion rate of at least 10% are applied onto the textile product within the substantially anaerobic dying chamber. Thereafter the dyed textile product may be exposed to an oxygen-containing atmosphere so as to oxidize the applied dyes. At least one of the dyes may have a dye exhaustion rate of at least about 25%, or even at least about 50%. The embodi-
(Continued)

Figure 1:
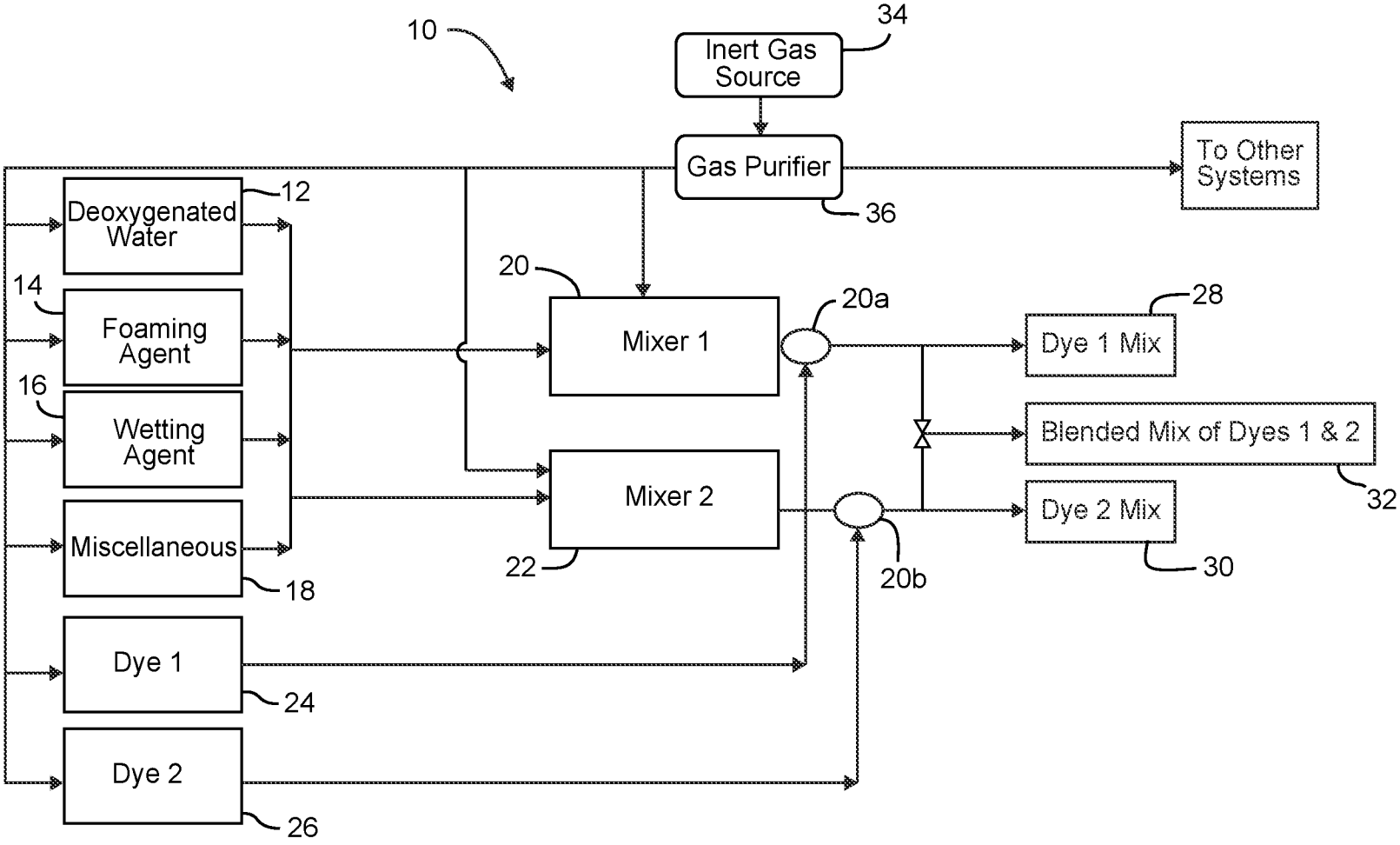

ments herein are especially adapted to dyeing of textile products whereby one dye in the at least two dye mixtures is a sulfur dye and another dye in the at least two dye mixtures is a leuco indigo dye.

21 Claims, 4 Drawing Sheets

(51) Int. Cl.

| | |
|---|---|
| ***D06B 19/00*** | (2006.01) |
| ***D06B 23/14*** | (2006.01) |
| ***D06P 1/22*** | (2006.01) |
| ***D06P 1/30*** | (2006.01) |
| ***D06P 5/00*** | (2006.01) |

(52) U.S. Cl.
CPC ..... *D06B 21/00* (2013.01); *D06B 23/14* (2013.01); *D06P 1/228* (2013.01); *D06P 1/30* (2013.01); *D06B 2700/36* (2013.01)

(58) Field of Classification Search
CPC .... D06B 21/00; D06B 23/14; D06B 2700/36; D06B 5/06; D06B 5/08; D06B 19/0005; D06B 23/16
USPC ..... 8/636
See application file for complete search history.

(56) References Cited

U.S. PATENT DOCUMENTS

| | | | | |
|---|---|---|---|---|
| 7,913,524 | B2 | 3/2011 | Aurich et al. | |
| 8,215,138 | B2 * | 7/2012 | Ronchi ..... | D06B 19/0005 8/476 |
| 10,619,292 | B2 | 4/2020 | Malpass et al. | |
| 2009/0308757 | A1 | 12/2009 | Crettenand | |
| 2011/0289697 | A1 * | 12/2011 | Meyer ..... | D06P 1/30 8/642 |
| 2018/0073192 | A1 * | 3/2018 | Malpass ..... | D06B 23/021 |

* cited by examiner

METHODS AND SYSTEMS TO DYE TEXTILE MATERIALS WITH DYE BLEND COMPOSITIONS HAVING DIFFERENTIAL DYE EXHAUST RATES

CROSS-REFERENCE TO RELATED APPLICATION

This application is the U.S. national phase of International Application No. PCT/US2021/013049 filed Jan. 12, 2021 which designated the U. S. and claims priority benefits from U.S. Provisional Application Ser. No. 62/961,917 filed on Jan. 16, 2020, the entire contents of which is expressly incorporated hereinto by reference.

FIELD

The embodiments disclosed herein relate generally to the dyeing of textile materials. In preferred forms, the embodiments disclosed herein relate to methods and systems whereby textile materials may be dyed with at least two dye compositions having different dye exhaust rates.

BACKGROUND

Water is used extensively throughout textile processing operations. Almost all dyes, specialty chemicals, and finishing chemicals are applied to textile substrates from water baths. The amount of water used varies widely in the industry, depending on the specific processes operated at the mill, the equipment used, and the prevailing management philosophy concerning water use. Reducing water consumption in textile processing is important for furthering pollution prevention efforts, in part because excess water use dilutes pollutants and adds to the effluent load. This effluent needs to be further treated. A reduction in water use and associated reduction in waste water generation is of critical importance in the textile industry.

Continuous dyeing is one of the most popular dyeing methods for woven fabric. Many dyes used in textiles are water insoluble. In the presence of a suitable reducing agent, pH and temperatures these dyes are made water soluble. High levels of salts are used to facilitate absorption of the dyes onto the substrate. Suitable reducing agents include sodium dithionate for vat dyes, sodium sulfide or sodium hydrosulfide. The substrate is immersed in to the dye solution. The dyes gradually diffuse into the fiber. Penetration is controlled by controlling the temperature and contact time of the dye solution with the textile substrate.

In continuous dyeing, the textile substrate contacts the dye solution in a dye bath and the fibers absorb the dyes. The concentration of the dye in the dye bath therefore gradually decreases as the dye uptake by the textile substrate progresses. The degree of such dyebath exhaustion as a function of time describes the rate and extent of the dyeing process. For a single dye, the exhaustion is defined as the ratio of the mass of dye taken up by the substrate to the total initial mass of dye in the bath. To ensure consistent amount of dye absorption onto the substrate, the dye bath is replenished continually as the dye is exhausted onto the substrate. Dye exhaust rates will vary significantly based on the chemical composition of the dye bath, temperature and the type of dye. Typically, multiple dyes are not often used in a single dye bath because of the difficulty keeping the different concentrations substantially constant.

By way of example, cotton yarns have been dyed with both indigo and sulfur dyes. However, to achieve cotton yarn dyeing it is typically necessary for dyeing to be conducted in multiple stages. Specifically, sulfur top dyeing is conducting by dyeing with indigo dye in one or more dye boxes followed by dyeing with a sulfur dye in other separate downstream dye boxes. Similarly, sulfur bottom dyeing is conducted by initially dyeing with sulfur dyes then subsequently dyeing with indigo dye. To avoid contamination, the yarn is washed in several intermediate wash boxes between the dyeing operations which in turn generates significant waste water with concomitant results that high levels of salt and other inorganic materials are present that require treatment. Directly blending an indigo dye with one or more sulfur dyes has not been done commercially.

It would therefore be very desirable commercially if methods and systems could be provided whereby dyes with differential dye exhaust rates could be applied onto a textile material to achieve desired dyeing results. It is towards providing such methods and systems that the embodiments disclosed herein are directed.

BRIEF DESCRIPTION

Broadly, the embodiments disclosed herein are directed toward methods and systems whereby a dye blend composition of indigo dye and one or more sulfur dye is delivered to a textile substrate so as to dye the substrate as desired. Both dyes are converted to a soluble state either by using pre-reduced dyes or reducing the dyes with suitable reducing agents. The dye blend composition may be stabilized by the use of additional chemicals such as buffers, pH modifiers, reducing agents, viscosity modifiers and the like which are conventionally employed in textile dyeing processes. The dye blend composition may be delivered to the textile substrate (e.g., textile, fabrics and the like) in a controlled manner using a low wet pick method. By way of example of a low-wet pickup method may be embodied in an anaerobic foam dyeing process using pre-reduced indigo (PRI) that eliminates the need for pretreatment of some yarns and for the need for reducing agents. More specifically, the dye compositions employed in the methods and systems of the embodiments disclosed herein may be applied by the techniques described in U.S. Pat. No. 10,619,292 to Malpass, et al, U.S. Pat. No. 8,215,138 to Ronchi and U.S. Pat. No. 7,913,524 to Aurich, et al, the entire contents of each being expressly incorporated hereinto by reference. Other low wet pickup methods are known in the art, for example, spraying the dye blend composition onto the substrate. Excess amounts of the dye blend composition that has not been absorbed by the textile substrate can be recycled for reuse and reapplication.

There are significant environmental benefits which ensue from the embodiments disclosed herein since the textile substrate does not have to be washed as many times thereby minimizing waste water that requires treatment. Additionally, by co-delivering multiple materials at the same significantly reduces capital costs. Further, the embodiments disclosed herein enable new shades and new wash down effects for textile products that are highly desired in the textile industry.

Textile treatment and dyeing specifically is a complex process and requires multiple process steps, uses large amounts of water and other auxiliary chemicals, generates significant waste water that needs to be treated. Results can also be inconsistent. The complex process and subsequent waste management can also add to the cost. Lastly, the process can be capital intensive with a large footprint. Delivering multiple materials with different exhaust rates makes the problem more challenging. This invention will address some of the challenges and will allow delivery of multiple ingredients with different exhaust rates simultaneously in an environmentally friendly manner.

By combining multiple materials with very different exhaust rates, the invention also delivers yarns and fabrics with unique properties which is a key goal of the fashion industry. Specifically, for denim this could lead to products with very unique shades and washdowns.

These and other aspects and advantages of the present invention will become more clear after careful consideration is given to the following detailed description of the preferred exemplary embodiments thereof.

BRIEF DESCRIPTION OF ACCOMPANYING DRAWINGS

Figure 2:
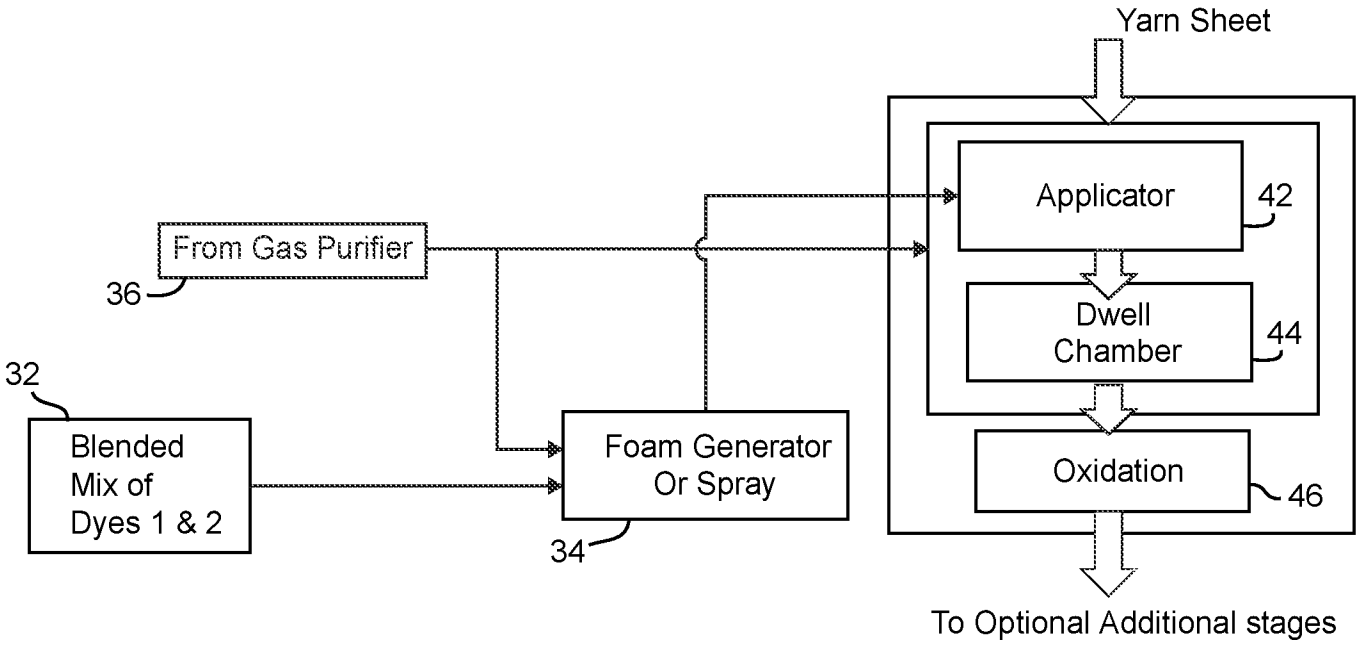
Figure 3:
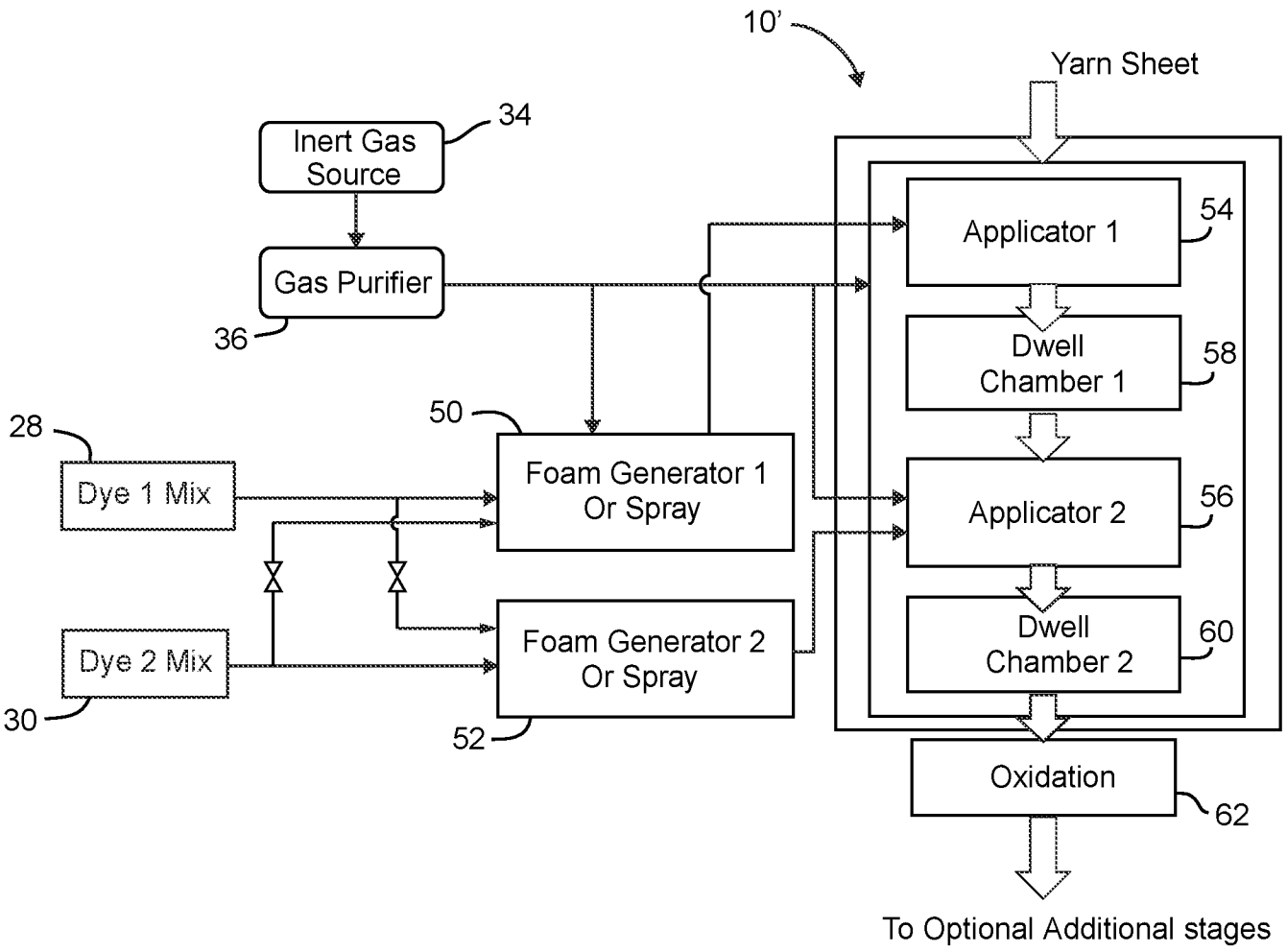
Figure 4:
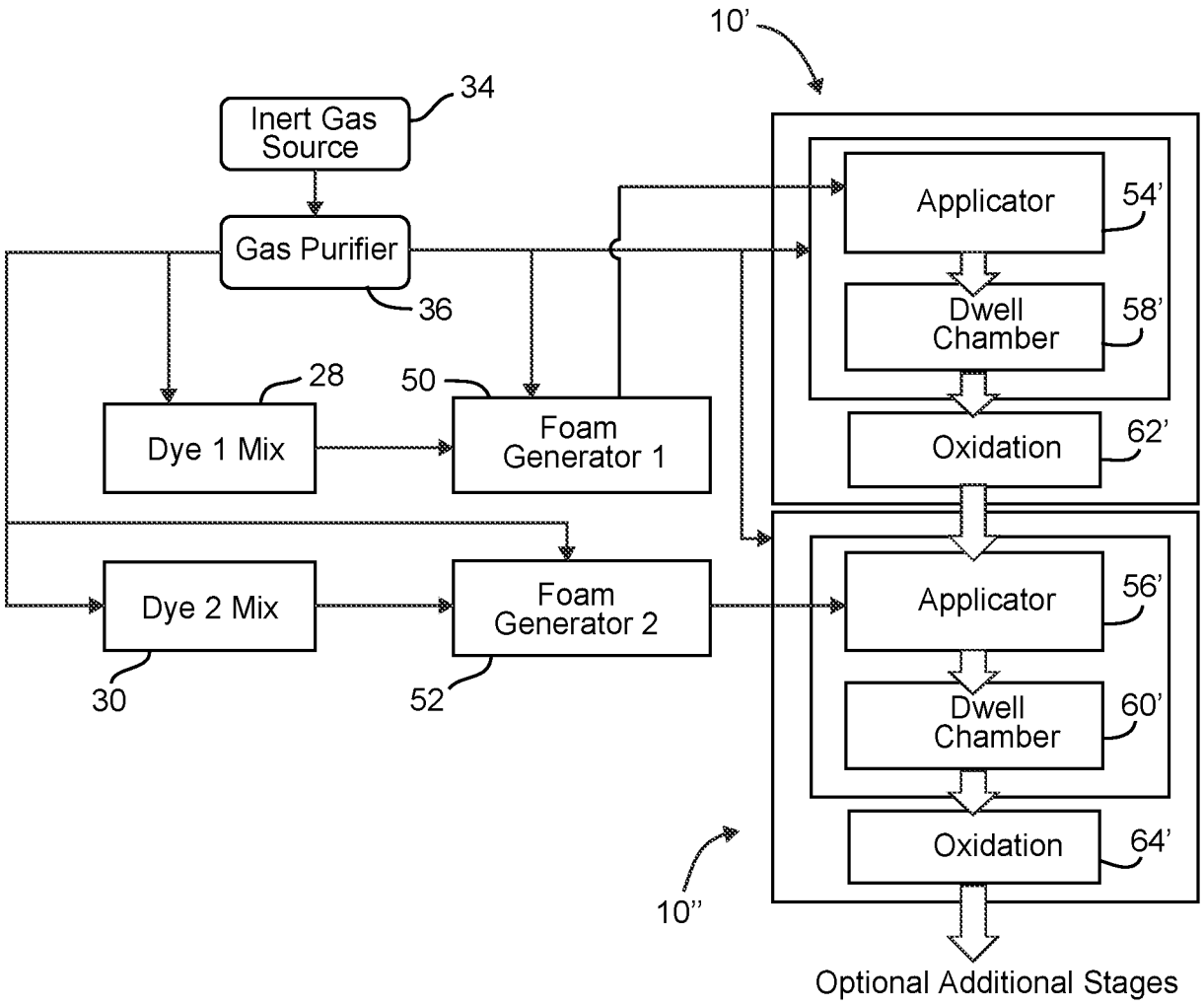

The disclosed embodiments of the present invention will be better and more completely understood by referring to the following detailed description of exemplary non-limiting illustrative embodiments in conjunction with the drawings of which:

FIGS. 1 and 2 are schematic flow charts of a system that may be employed in the practice of the embodiments disclosed herein to form a blended mixture of at least two different dyes having differential dye exhaust rates; and FIGS. 3 and 4 are schematic flow charts showing alternative textile application techniques for the separate application of at least two different dyes having differential dye exhaustion rates onto a textile substrate.

DETAILED DESCRIPTION OF EMBODIMENTS

A. Definitions

As used herein and in the accompanying claims, the terms below are intended to have the following definition:

"Filament" means a fibrous strand of extreme or indefinite length.

"Fiber" means a fibrous strand of definite length, such as a staple fiber.

"Yarn" means a collection of numerous filaments or fibers which may or may not be textured, spun, twisted or laid together.

"Textile material" means any filament, fiber and/or yarn formed of a synthetic (man-made) or natural material.

"Fabric" means a textile material in the form of a cloth formed of a cloth formed of non-woven, woven or knitted filaments, fibers and/or yarns.

"Dye" means a natural or synthetic substance that adds color to or changes the color of a material to which it is applied.

"Dye exhaustion" or "dye exhaust" means the percentage (%) mass of dye that is taken up from a dye bath by a textile material relative to the original mass of dye in the dye bath.

"Dye exhaustion rate" or "dye exhaust rate" means the percentage (%) mass of dye that is taken up from a dye bath by a textile material relative to the original mass of dye in the dye bath per unit time (hr.).

"Differential dye exhaustion" means the absolute numerical percentage difference of two dyes having different dye exhaust rates.

"Dye mixture" means an aqueous mixture or blend of one dye in water with other optional components such as foaming agents, wetting agents, reducing agents and the like.

"Sulphur bottoming" means indigo dyeing being applied initially to a textile material before the application of indigo dyeing to produce textile products having a darker, brighter effect.

"Sulfur topping" means sulfur dye being applied to a textile material after the indigo dyeing.

"Foaming agent" is a chemical which causes foaming of the liquid dye composition, including for example, nonionic, anionic, cationic and awitterionic surfactants.

"Wetting agent" is a surfactant which lowers the advancing contact angle and aids in displacing air at the interface with the liquid phase. Suitable wetting agents include nonionic, anionic, cationic and zwitterionic surfactants such as glucosides, amine oxides, sulfosuccinates, sulfonates, phosphonates, ethoxylates and the like. Wetting agents with a Draves wetting time of <40 seconds are preferred. The same material may serve as both a foaming agent and a wetting agent.

B. Description of Embodiments

As is schematically depicted below in formula (I), an indigo dye molecule may be reduced to its leuco form by contact with, e.g., sodium dithionite, which in turn may then be reconverted to an indigo dye molecule via oxidation (e.g., exposure to an oxygen-containing environment, typically atmospheric air).

Formula (I)

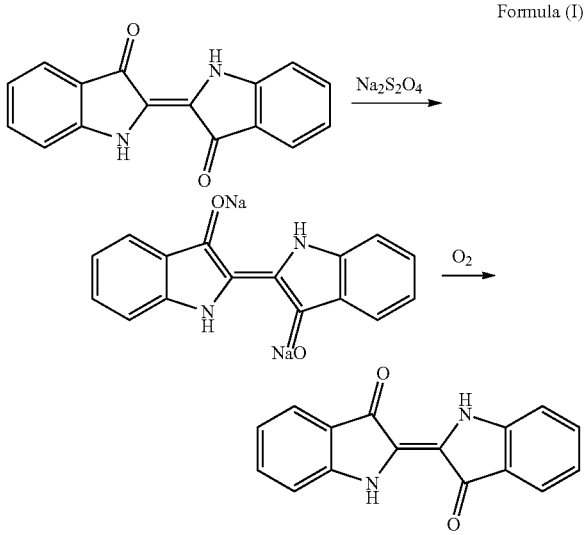

The indigo dye molecule is deep blue in color whereas the leuco form of the molecule is yellowish in color. It is the leuco form of the indigo dye molecule (sometimes hereinafter more simply referenced as "leuco-indigo") which is employed in the practice of the embodiments described herein. The leuco-indigo (sometimes referenced in the art as "pre-reduced indigo") may be obtained from various commercial sources, for example, from DyStar Textilfarben GmbH & Co., manufactured according to U.S. Pat. No. 6,428,581 (the entire content of which is expressly incorporated hereinto by reference).

Sulfur dyes commonly used as add-on for black, blue, brown, khaki and green colors. Sulfur dyes can be applied with little difficulty and with excellent results at a relatively low cost. Sulfur dyeing procedures have been used to create a range of colors in conjunction with indigo.

Sulfur augmentation is also typically used in denim business. For example, sulfur bottoming may be employed to produce a darker color of a cotton yarn or textile fabric with less indigo. Sulfur topping on the other hand permits much darker color than sulfur bottoming can achieve, but is typically duller in appearance. Sulfur topping colors include black, blue-black, yellow brown and green. Sulfur toppings are used to produce slub appearances in normal yarn.

The embodiments of this invention address at least some of these challenges in the current art.

In general, the embodiments disclosed herein employ dye compositions comprised of a uniform blend or mixture of at least two dyes with different dye exhaustions that are applied to a textile material (e.g., textile materials formed of natural fibers, e.g., cotton) in a low-wet pick technique. The differential dye exhaustions of the dyes in the blend or mixture of dyes is most preferably at least 10%, preferably at least about 20% and more preferably at least about 50%. At least one of the dyes of the at least two dyes will preferably have a dye exhaust rate at the dyeing conditions of the textile product of at least about 25%, preferably at least about 50%.

The blend is applied onto the textile material substrate in a controlled manner using low wet application techniques such as direct metering of (a) the neat liquid due blend, (b) foam that is produced by incorporating gas into the dye liquid in the presence of a foaming agent, or (c) dye liquid spray of uniform droplet sizes. It could also include other methods such as passing the substrate through a kiss roll or a puddle. During application, the environmental conditions around the applicator, such as temperature, humidity and oxygen levels, need to be maintained to maintain stability of the liquid.

Once the dye liquid blend has been applied, the dyes will diffuse into the textile material substrate for a period of a few seconds, e.g., about 5 to about 120 seconds. During this period of time, the textile material substrate needs to be in an environment that ensures stability while promoting diffusion/penetration into the substrate.

After the diffusion step, the substrate is treated chemically or by heat to cause the materials to become insoluble.

Specific embodiments of the invention are shown schematically by FIGS. 1-4. As can be seen from FIG. 1, a system 10 is provided with a number of sources (e.g., vats or containers) of chemical constituents that may be included in the dye liquid formulation, including a source 12 for deoxygenated water, a source 14 for a foaming agent, a source 16 for a wetting agent and a source 18 for miscellaneous auxiliary materials. The various constituents from sources 12-18 may be metered as needed to Mixer 1 and Mixer 2 identified by blocks 20, 22, respectively whereby can be homogenously mixed together.

Dyes having different dye exhaustions identified as Dye 1 and Dye 2 may be withdrawn from sources 24, 26 and introduced with the mixed chemicals downstream of the Mixer 1 and Mixer 2, respectively (e.g., by being introduced to the downstream constituent mixture via a static in-line mixer 20*a*, 20*b*, respectively) thereby forming a liquid Dye 1 Mix and Dye 2 Mix as identified by blocks 28, 30, respectively. Preferably, these liquid dye mixtures of Dye 1 Mix and Dye 2 Mix are blended together to form a blend or mixture of dyes identified by block 32.

As shown in FIG. 1, all sources and unit operations in the system 10 are maintained in an essentially deoxygenated (anaerobic) state (i.e., an oxygen content of less than about 1000 ppm oxygen, preferably less than about 500 ppm oxygen, or less than about 200 ppm oxygen, or less than about 100 ppm oxygen, or less than about 75 ppm oxygen or even less than about 50 ppm oxygen, including essentially 0 ppm oxygen) by providing an inert gas to the same from an inert gas source 34 that has been purified via gas purifier 36.

As shown in FIG. 2, the blended liquid mixture of Dyes 1 and 2 from block 32 may be directed toward a foam generator or spray generator 34 form a foam or spray, respectively of the dye mixture that can then be supplied to an applicator 42 within the dyeing apparatus 40. The apparatus 40 may be, for example the apparatus as more fully disclosed in U.S. Pat. No. 10,619,292 whereby the liquid dye mixture is applied to a textile material (e.g., a sheet of parallel yarns) via the applicator 42 and transferred subsequently to a dwell chamber 44 to allow dye penetration into the textile material all under an inert atmosphere (preferably substantially anaerobic) due to the inert gas supplied from the gas purifier 36. Thereafter, the dyed yarns in the yarn sheet may be exposed to oxygenated conditions (e.g., ambient oxygen) as identified by block 46 to thereby oxidize the indigo dye molecule and achieve the indigo color. The dyed yarn sheet may then be passed to further downstream processing stations, e.g., drying and/or winding operations.

FIG. 3 shows a similar system to that described above for FIG. 2 with the principal exception being that individual supplies of Dye 1 and Dye 2 noted by blocks 28 and 30, respectively may be directed to respectively separate foam or spray generators identified by blocks 50, 52. These separate foam or spray generators 50, 52 may then in turn separately supply dedicated applicators identified by blocks 54, 56, respectively, within the dying apparatus 10' each of which is provided with a separate downstream dwell chamber identified by blocks 58, 60, respectively.

As yet a further embodiment, the system shown in FIG. 3 may be modified as shown in FIG. 4 so as to include a sequential series of dye apparatus 10', 10", each of which is provided with separate applicators 54', 56', dwell chambers 58', 60' and oxidation zones 62', 64'.

The embodiments disclosed herein will be further understood by reference to the following examples.

EXAMPLES

The Dye Mix 1 may contain the following constituents:

- Total Water content=up to 50 wt. %, preferably up to 30 wt. %, based on total weight of the liquid dye mixture
- Dye 1: Soluble form of indigo/vat dyes (i.e., reduced Leuco or Prereduced Leuco dyes) in an amount of about 10 wt. % to about 90 wt. %
- Foaming+Wetting agents in an amount of 0.1 wt. % to about 10 wt. %
- Miscellaneous constituents: e.g., viscosity modifiers, pH adjustors and/or reducing Agents The following Table 1 shows exemplary formulations for the Dye Mix 1:

TABLE 1

| | Ex 1-1 | Ex 1-2 | Ex 1-3 | Ex 1-4 | Ex 1-5 | Ex 1-6 | Ex 1-7 |
|---|---|---|---|---|---|---|---|
| Foaming Agent | Unifroth 1672 (100%) @ 3 wt % | Unifroth 1672 (100%) @ 3 wt % | Unifroth 1672 (100%) @ 2 wt % | Unifroth 1672 (100%) @ 3 wt % | Unifroth 1672 (100%) @ 3 wt % | Ecosurf SA 7 (100%) @ 2 wt % | Ammonyx LMDO (40%) @ 5 wt % |
| Wetting Agent | Uniwet 2413 (25%) @ 8 wt % | Glucopon 215 (60%) @ 1 wt % | Glucopon 420 UP (60%) @ 2 wt % | Atesan LPW @ 2 wt % | Atesan LPW @ 2 wt % | Glucopon 420 UP (60%) @ 2 wt % | Glucopon 420 UP (60%) @ 2 wł% |

TABLE 1-continued

| | Ex 1-1 | Ex 1-2 | Ex 1-3 | Ex 1-4 | Ex 1-5 | Ex 1-6 | Ex 1-7 |
|---|---|---|---|---|---|---|---|
| Dye 1 | Prereduced Indigo (40 vol %) @ 20 wt % | Prereduced Indigo (40%) @ 10 wt % | Prereduced Indigo (40%) @ 10 wt % | Prereduced Indigo (40%) @ 0.5 wt % | Prereduced Vat Blue 36 @ 8 wt % | Prereduced Indigo (40%) @ 10 wt % + Prereduced Vat Green 1 @ 0.4% | Prereduced Indigo (40%) @ 10 wt % |
| Water | balance | balance | balance | balance | balance | balance | balance |

The Dye Mix 2 may contain the following constituents:

Total Water content=up to 50 wt. %, preferably up to 30 wt. %, based on total weight of the liquid dye mixture Dye 2: Reduced form of at least one sulfur dye in an amount of about 10 wt. % to about 90 wt. %

Foaming+Wetting agents in an amount of 0.1 wt. % to about 10 wt. %

Miscellaneous constituents: e.g., viscosity modifiers, pH adjustors and/or reducing Agents The sulfur dyes forming Dye 2 may be one or more of the following:

Leuco Sulfur Black 1: Diresul brand (RDT Black or Indiblack RDT or Fast black) or Patcosul Black or equivalent.

Leuco Sulfur Navy: Diresul brand Indinavy RDT or Navy RDT or equivalent

Leuco Sulfur Blue: Diresul (Blue or Indiblue RDT or Arctic Blue or Pacific Blue or Caribbean blue)

Leuco Sulfur RDT Colors: Diresul (Yellow RDT, Orange RDT, Brown RDT, Red RDT, Green RDT, Olive RDT)

The following Table 2 shows exemplary formulations for the Dye Mix 2:

TABLE 2

| | Ex 2-1 | Ex 2-2 | Ex 2-3 | Ex 2-4 | Ex 2-5 | Ex 2-6 | Ex 2-7 |
|---|---|---|---|---|---|---|---|
| Foaming Agent | Unifroth 1672 (100%) @ 3 wt % | Unifroth 1672 (100%) @ 3 wt % | Unifroth 1672 (100%) @ 2 wt % | Unifroth 1672 (100%) @ 3 wt % | Unifroth 1672 (100%) @ 3 wt % | Ecosurf SA 7 (100%) @ 2 wt % | Ammonyx LMDO (40%) @ 5 wt % |
| Wetting Agent | Uniwet 2413 (25%) @ 8 wt % | Glucopon 215 (60%) @ 1 wt % | Glucopon 420 UP (60%) @ 2 wt % | Atesan LPW @ 2 wt % | Atesan LPW @ 2 wt % | Glucopon 420 UP (60%) @ 2 wt % | Glucopon 420 UP (60%) @ 2 wt % |
| Dye 2 | Sulfur Black 1 (Sulfur RDT 4G) @ 0.7 wt. % | Sulfur Black 1 (Sulfur RDT 4G) @ 1.0 wt. % | Sulfur Black 1 (Sulfur RDT 4G) @ 20 wt. % | Leuco Sulfur Black @ 0.7 wt % and Sulfur Navy @ 0.4 wt. % | Diresul Red @ 3.0 wt. % | Diresul Greet RDT @ 4.0 wt. % | Diresul Indiblack @ 20 wt. % |
| Viscosity Modifier | | | Thickner 2515 @ 0.5 wt. % | | | Thickner 2515 @ 4 wt. % | |
| Water | balance | balance | balance | balance | balance | balance | balance |

The blended mix of Dye 1 and Dye 2 will thus preferably include:

Total Water content=up to 50 wt. %, preferably up to 30 wt. %, based on total weight of the liquid dye mixture Dye 1 and Dye 2 in an amount of about 10 wt. % to about 90 wt. % based on total weight of the blended mix of Dye 1 and Dye 2, with Dye 2 being present in an amount of 0.1 to 99 wt. %, preferably between about 1.0 to about 75 wt. %, e.g., about 10 to about 60 wt. %, based on the total amount of Dye 1 and Dye 2 in the blended mix.

Foaming+Wetting agents in an amount of 0.1 wt. % to about 10 wt. %

Miscellaneous constituents: e.g., viscosity modifiers, pH adjustors and/or reducing Agents The following Table 3 shows exemplary formulations for the blended mix of Dyes 1 and 2:

TABLE 3

| | Ex 3-1 | Ex 3-2 | Ex 3-3 | Ex 3-4 | Ex 3-5 | Ex 3-6 | Ex 3-7 |
|---|---|---|---|---|---|---|---|
| Foaming Agent | Unifroth 1672 (100%) @ 3 wt % | Unifroth 1672 (100%) @ 3 wt % | Unifroth 1672 (100%) @ 3 wt % | Unifroth 1672 (100%) @ 2 wt % | Unifroth 1672 (100%) @ 3 wt % | Unifroth 1672 (100%) @ 3 wt % | Unifroth 1672 (100%) @ 3 wt % |
| Wetting Agent | Uniwet 2413 (25%) @ 8 wt % | Glucopon 215 (60%) @ 1 wt % | Glucopon 215 (60%) @ 2 wt % | Glucopon 420 (60%) @ 2 wt % | Glucopon 215(60%) @ 2 wt % | Glucopon 215(60%) @ 2 wt % | Uniwet 2413 (25%) @ 8 wt % |
| Dye 1 | Prereduced Indigo (40%) @ 20 wt % | Prereduced Indigo (40%) @ 20 wt % | Prereduced Indigo (40%) @ 7.5 wt % | Prereduced Indigo (40%) @ 10 wt % | Prereduced Indigo (40%) @ 0 wt % | Prereduced Indigo (40%) @ 0 wt % | Prereduced Indigo (40%) @ 20 wt % |
| Dye 2 | Leuco Sulfur Black 1 (Sulfur RDT 4G) @ 0.7 wt % | Leuco Sulfur Black 1 (Sulfur RDT 4G) @ 1 wt % | Leuco Sulfur Black 1 (Sulfur RDT 4G) @ 20 wt % | Leuco Sulfur Black @ 0.7% and Sulfur Navy @ 0.4% | Diresul Red @ 3% | Diresul Green RDT @ 4% | Sulfur RDT 4G @ 0.7 wt % |
| Viscosity Modifier | | | Thickener 2515 @ 0.5% | | Thickener 2515 @ 2% | Thickener 2515 @ 5% | |
| Water | balance | balance | balance | balance | balance | balance | balance |

While reference is made to a particular embodiment of the invention, various modifications within the skill of those in the art may be envisioned. Therefore, it is to be understood that the invention is not to be limited to the disclosed embodiment, but on the contrary, is intended to cover various modifications and equivalent arrangements included within the spirit and scope thereof.

What is claimed is:

1. A process for dyeing a textile product comprising the steps of:

(a) introducing an undyed textile product into at least one substantially anaerobic dyeing chamber having an oxygen content of less than 1000 ppm oxygen therein;

(b) applying onto the textile product within the at least one substantially anaerobic dying chamber at least two dye mixtures having a differential dye exhaustion rate of at least 10%; and thereafter (c) discharging the textile product dyed according to step (b) so as to expose the textile product to an oxygen-containing atmosphere.

2. The process according to claim 1, wherein at least one of the dyes in the dye mixture has a dye exhaustion rate of at least about 25%.

3. The process according to claim 2, wherein at least one of the dyes in the dye mixture has a dye exhaustion rate of at least about 50%.

4. The process according to claim 1, wherein one of the dyes in the at least two dye mixtures is a sulfur dye.

5. The process according to claim 4, wherein the sulfur dye is present in an amount between about 0.1 to 99 wt. %, based on total weight of the dyes in the at least two dye mixtures.

6. The process according to claim 5, wherein the sulfur dye is present in an amount between 1.0 to 75 wt. %, based on the total weight of the dyes in the at least two dye mixtures.

7. The process according to claim 5, wherein the sulfur dye is present in an amount between 10 to 60 wt. %, based on the total weight of the dyes in the at least two dye mixtures.

8. The process according to claim 4, wherein another dye in the at least two dye mixtures is a leuco indigo dye.

9. The process according to claim 1, wherein the at least two dye mixtures respectively comprise a sulfur dye and a leuco indigo dye.

10. The process according to claim 9, wherein step (b) comprises forming a blend of the at least two dye mixtures and then applying the blend of the at least two dye mixtures onto the textile product.

11. The process according to claim 1, wherein first and second ones of the at least two dye mixtures are applied successively onto the textile product in respective substantially anaerobic dyeing chambers each having an oxygen content of less than 1000 ppm oxygen therein.

12. The process according to claim 11, wherein the process comprises exposing the textile product to an oxygen environment intermediate of the respective substantially anaerobic dyeing chambers.

13. The process according to claim 11, wherein the process comprises at least partially drying the textile product intermediate of the respective substantially anaerobic dyeing chambers.

14. An apparatus for dyeing a textile product comprising:

at least one substantially anaerobic dyeing chamber having an oxygen content of less than 1000 ppm therein for dyeing a textile product; and a dye application system to apply onto the textile product within the substantially anaerobic dying chamber at least two dye mixtures having a differential dye exhaustion rate of at least 10%.

15. The apparatus according to claim 14, which further comprises a mixer for blending the at least two dye mixtures with one another.

16. The apparatus according to claim 14, which further comprises first and second substantially anaerobic dyeing chambers each having an oxygen content of less than 1000 ppm for successively dyeing the textile product with first and second ones of the at least two dye mixtures, respectively.

17. The apparatus according to claim 16, which further comprises an oxygen environment intermediate the first and second substantially anaerobic dyeing chambers.

18. The apparatus according to claim 16 which further comprises a drier intermediate the first and second substantially anaerobic dyeing chambers.

19. The apparatus according to claim 14, further comprising a drier downstream of the at least one dyeing chamber.

20. The apparatus according to claim 14, which further comprises an inert gas system for supplying an inert gas to the at least one dyeing chamber.

21. A dyed textile product which is produced by the process according to claim 1.

* * * * *